US010508877B2

(12) United States Patent
Peknik

(10) Patent No.: US 10,508,877 B2
(45) Date of Patent: Dec. 17, 2019

(54) SUPPRESSOR WITH SELECTABLE VENTING

(71) Applicant: Daniel Nicholas Peknik, Fort Bragg, CA (US)

(72) Inventor: Daniel Nicholas Peknik, Fort Bragg, CA (US)

( * ) Notice: Subject to any disclaimer, the term of this patent is extended or adjusted under 35 U.S.C. 154(b) by 0 days.

(21) Appl. No.: 16/127,753

(22) Filed: Sep. 11, 2018

(65) Prior Publication Data

US 2019/0078852 A1 Mar. 14, 2019

Related U.S. Application Data

(60) Provisional application No. 62/557,722, filed on Sep. 12, 2017, provisional application No. 62/696,041, filed on Jul. 10, 2018.

(51) Int. Cl.
*F41A 21/00* (2006.01)
*F41A 21/30* (2006.01)

(52) U.S. Cl.
CPC ..... *F41A 21/30* (2013.01)

(58) Field of Classification Search
CPC ..... F41A 21/30; F41A 21/325
USPC ..... 89/14.4, 14.05; 181/223; 29/428
See application file for complete search history.

(56) References Cited

U.S. PATENT DOCUMENTS 4,207,799 A * 6/1980 Tocco ..... F41A 21/325 89/14.3
4,374,484 A * 2/1983 Bekker ..... F41A 21/38 89/14.3
4,429,614 A * 2/1984 Tocco ..... F41A 21/36 89/14.3
7,353,741 B2 * 4/2008 Brixius ..... F41A 13/06 42/90
7,891,284 B1 * 2/2011 Barrett ..... F41A 5/28 89/14.4
7,905,171 B1 * 3/2011 Brittingham ..... F41A 21/30 89/14.4
8,286,750 B1 * 10/2012 Oliver ..... F41A 21/30 181/223
8,561,757 B1 * 10/2013 Edsall ..... F41A 21/30 181/223
8,826,579 B2 * 9/2014 Lippard ..... B23D 77/14 42/76.1
10,088,261 B1 * 10/2018 Oglesby ..... F41A 21/34
10,422,604 B2 * 9/2019 Niswander ..... F41A 3/66
(Continued)

*Primary Examiner* — Michael D David
(74) *Attorney, Agent, or Firm* — Phillip M. Wagner

(57) ABSTRACT

An example embodiment of a sound suppressor includes a shroud tube slidably and rotationally coupled to a vent tube. The vent tube is formed with a plurality of vent tube apertures in fluid communication with a bore extending from a first end to a second end of the vent tube. The shroud tube is formed with a plurality of shroud apertures in fluid communication with an interior void formed in the shroud tube. A rear cap attached to the vent tube is configured for attachment to the muzzle of a firearm. An indexing mechanism is configured for selectively holding the vent tube and shroud tube in an open-vent configuration with the apertures on both tubes overlapping one another, or in a closed-vent configuration with the apertures not overlapping. Sound suppression is enabled in the closed-vent configuration and minimized in the open-vent configuration.

10 Claims, 6 Drawing Sheets

(56) References Cited

U.S. PATENT DOCUMENTS

| | | | | |
|---|---|---|---|---|
| 2006/0123983 | A1* | 6/2006 | Vais | F41A 21/30<br>89/14.3 |
| 2010/0287810 | A1* | 11/2010 | Kleppe | F16M 11/28<br>42/94 |
| 2013/0276341 | A1* | 10/2013 | Wells | F41G 11/003<br>42/71.01 |
| 2015/0211820 | A1* | 7/2015 | McRee | F41A 11/02<br>42/16 |
| 2015/0323275 | A1* | 11/2015 | Lessard | F41A 21/34<br>89/14.4 |
| 2017/0205178 | A1* | 7/2017 | Niswander | F41A 21/36 |

* cited by examiner

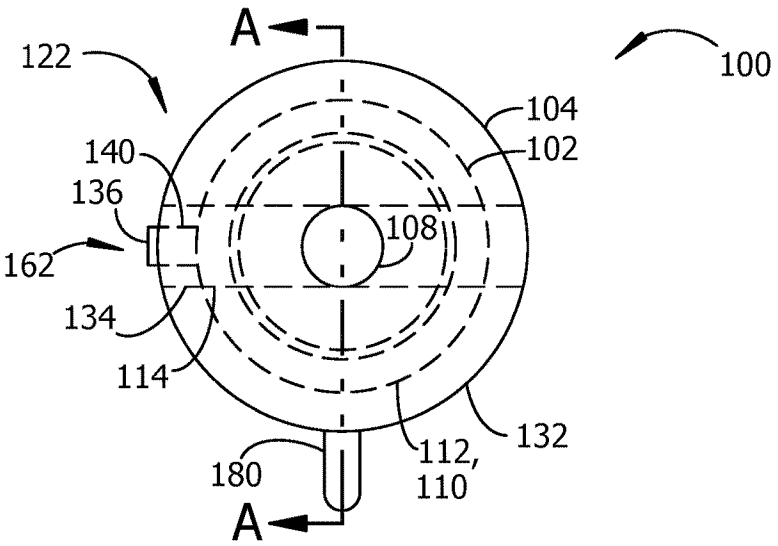
Fig. 7
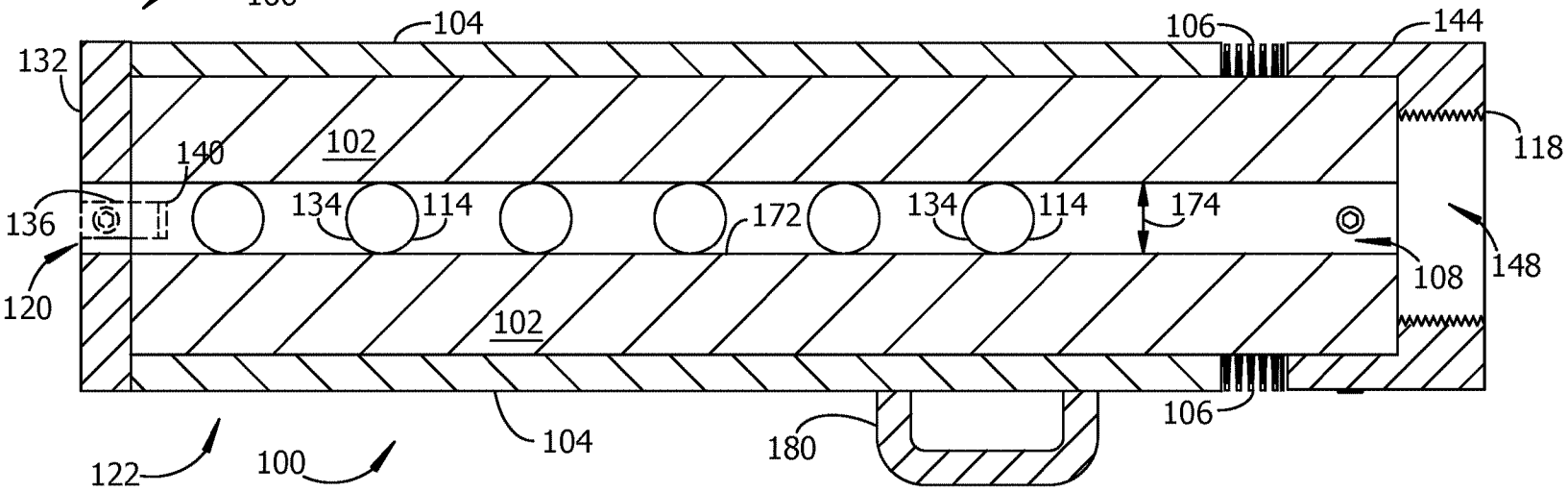
Fig. 8 SECTION A - A

SUPPRESSOR WITH SELECTABLE VENTING

CROSS REFERENCE TO RELATED APPLICATIONS

This application claims the benefit of U.S. Provisional Application No. 62/557,722, filed Sep. 12, 2017, incorporated herein by reference in its entirety, and further claims the benefit of U.S. Provisional Application No. 62/696,041, filed Jul. 10, 2018, incorporated herein by reference in its entirety.

FIELD OF THE INVENTION

Embodiments are related to apparatus for reducing the loudness of sound emitted from the muzzle of a firearm being discharged.

BACKGROUND

A firearm being discharged may produce a sound loud enough to be an unwanted disturbance to people and animals within hearing range of the discharge. The sound may be loud enough to damage the hearing of the person using the firearm. Nearby persons may be distracted or disturbed by the loud discharge sound and may also be at risk of hearing damage. Exposure to such loud sounds may be fatiguing or distracting.

The loudness perceived by a person and the measured sound intensity of the discharge sound may be reduced substantially by attaching a sound-reducing device to the muzzle end of the firearm's barrel. The sound-reducing device may cool and diffuse gaseous and particulate combustion products expelled from a firearm's barrel when the firearm is discharged. However, hot gas and particulate matter expelled during discharge may interfere with the sound-reducing operation of some devices. Hot material leaving the barrel may heat the sound-reducing device sufficiently to damage the device. Back pressure from a sound-reducing device may slow the ejection of combustion products from the barrel, possibly increasing the accumulation of material inside the barrel. Material accumulating inside the barrel may alter the trajectory of a projectile. Back pressure from a sound-reducing device may reduce the firing accuracy and/or range of the firearm. Discharge of the firearm may generate sufficient pressure inside a sound-reducing device to cause mechanical failure of the device, possibly resulting in the dispersal of high-velocity and/or high-temperature fragments that pose a safety hazard to the person discharging the firearm and to other persons nearby. High temperatures and pressures from discharge of the firearm may cause changes in positions of internal parts of a sound reducing device, possibly leading to a projectile striking parts of the device. A projectile strike on an internal structure of a sound reducing device may fragment the projectile, change the projectile's trajectory, or damage the sound reducing device.

Frequent cleaning of the barrel and the sound-reducing device may be needed to maintain the accuracy of the firearm and the sound-reducing capabilities of the sound-reducing device. Removing a sound-reducing device for cleaning or to disable sound reduction, for example to discharge the firearm to intentionally produce a loud acoustic signal, alters the weight and balance of a firearm and may affect firing accuracy until the person using the firearm adapts to the new weight and balance. To avoid injury from contact with hot exterior surfaces of the sound-reducing device, it may be necessary to wait until the device cools before it can be removed from the barrel.

SUMMARY

An example embodiment of a sound suppressor includes a vent tube formed with a bore extending from a first end of the vent tube to a second end of the vent tube. The vent tube is also formed with a plurality of vent tube apertures, each of the vent tube apertures passing through an outer surface of the vent tube into the bore. The example embodiment further includes a shroud tube movably coupled to the vent tube. The shroud tube is formed with a plurality of shroud apertures in fluid communication with an interior void formed in the shroud tube. A rear cap is attached to the vent tube, the rear cap configured for attachment to the muzzle of a firearm. An indexing mechanism is configured for selectively holding the vent tube and shroud tube in an open-vent configuration and a closed-vent configuration.

The vent tube may be positioned within the interior void formed in the shroud tube.

The shroud apertures do not overlap the vent tube apertures in the closed-vent configuration. The shroud apertures are not in fluid communication with the bore in the closed-vent configuration. The shroud apertures at least partially overlap the vent tube apertures in the open-vent configuration. The shroud apertures are in fluid communication with the vent apertures and the bore in the open-vent configuration.

The indexing mechanism may include a latch block attached to the vent tube; a vent-open notch formed in the shroud tube, the vent-open notch positioned to align the plurality of vent tube apertures with the plurality of shroud apertures when the latch block engages the vent-open notch; and a vent-closed notch formed in the shroud tube, the vent-closed notch positioned to prevent overlap of the vent tube apertures and the shroud apertures when the latch block engages the vent-closed notch, thereby preventing fluid communication between the shroud apertures and the bore.

The indexing mechanism may alternatively include a ball spring plunger attached to the vent tube; a vent-open detent formed in the shroud tube, the vent-open detent positioned to align the plurality of vent tube apertures with the plurality of shroud apertures when the ball spring plunger engages the vent-open detent; and a vent-closed detent formed in the shroud tube, the vent-closed detent positioned to prevent overlap of the vent tube apertures and the shroud apertures when the ball spring plunger engages the vent-closed detent.

A sound suppressor embodiment may include a spring interposed between an end of the shroud tube and the first end of the vent tube, wherein the spring is positioned to urge the end of the shroud tube away from the first end of the vent tube.

BRIEF DESCRIPTION OF THE DRAWINGS

FIG. 7 shows a view toward the discharge end of an example sound suppressor.

FIG. 8 is a cross-sectional view of the example sound suppressor of FIG. 7. A position and viewing direction for the sectional view is marked by a section line A-A in FIG. 7.

DESCRIPTION

Figure 1:
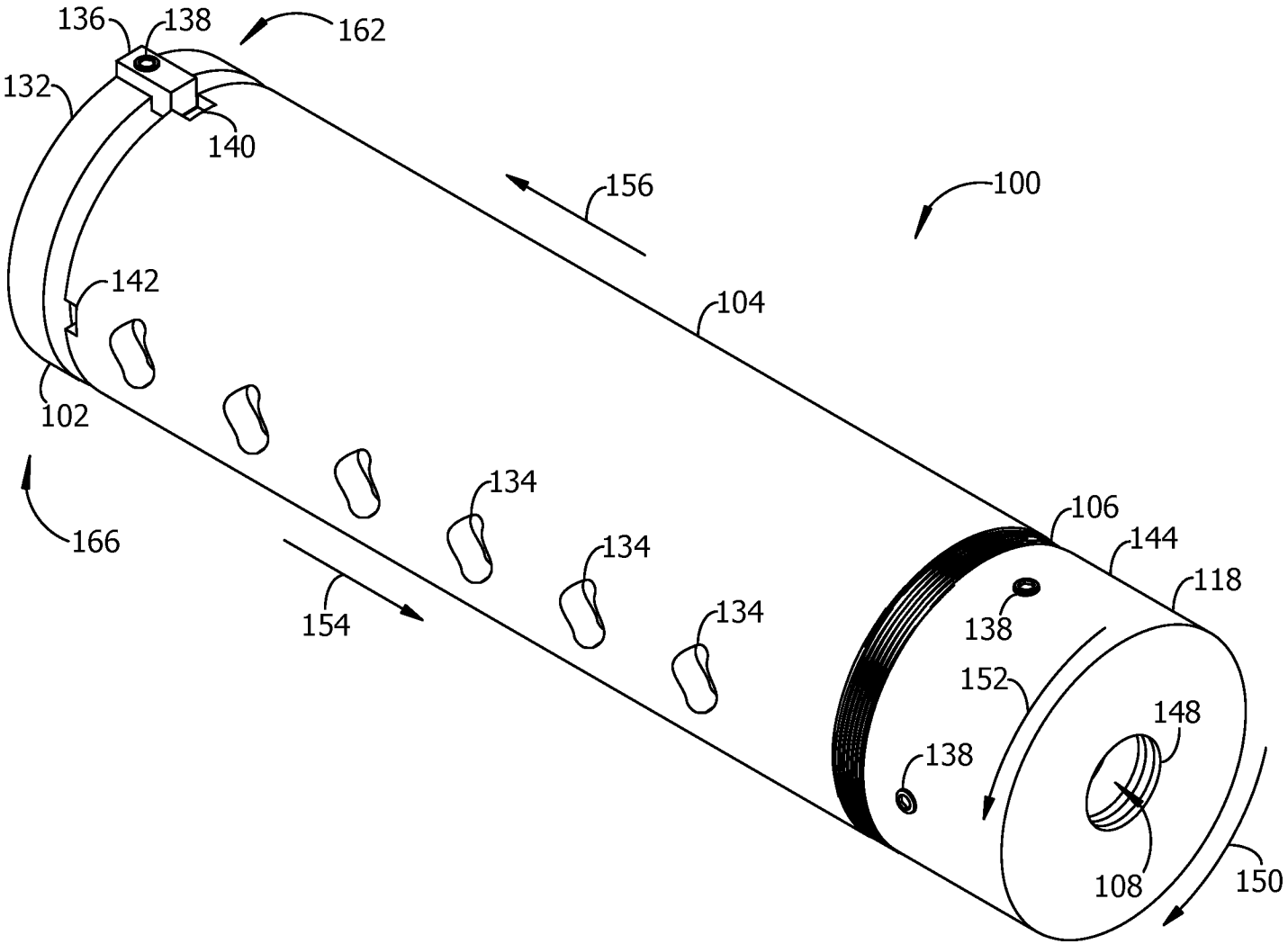
FIG. 1 shows a pictorial view toward a rear cap on an example of an apparatus embodiment.

An example apparatus embodiment, referred to herein as a sound suppressor, is configured for removable attachment to the muzzle end of a barrel on a firearm. The examples of a sound suppressor disclosed herein are selectively configurable for reducing the perceived loudness and/or measured intensity of sound emitted from the muzzle during firearm discharge and for discharging the firearm without sound reduction. Embodiments of a sound suppressor are effective for use with many different types of firearms, different types of propellants such as gunpowder and compressed gas, and different types of ammunition.

A sound suppressor in accord with an embodiment includes a vent tube formed with a bore through which a projectile may pass. A rear cap attached to an end of the vent tube is configured for removable attachment to the barrel of the firearm. An outer tube, also referred to as a shroud tube, is rotatable about the vent tube. The shroud tube is captured on the vent tube between the rear cap and an end cap at an end of the vent tube opposite the rear cap.

An indexing mechanism permits the shroud tube to be held firmly in at least two selectable rotational positions on the vent tube. When the indexing mechanism is engaged, the shroud tube is held in one of at least two selectable rotational positions relative to the vent tube. When the indexing mechanism is disengaged, the shroud tube may be rotated freely about the vent tube. In some embodiments of a sound suppressor, the selectable rotational positions correspond to enablement and disablement of sound reduction by the sound suppressor. In alternative embodiments of a sound suppressor, more than two selectable rotational positions may be provided to support selectable levels of sound suppression.

In a selectable rotational position referred to as an open-vent configuration, apertures formed in the vent tube at least partially overlap apertures formed in the shroud tube, enabling compressed gas and/or particles from firearm discharge to exit through the aligned apertures to the outside atmosphere. The open-vent configuration disables sound suppression and reduces back pressure from the sound suppressor in the barrel, possibly increasing a value of mean time between failures for the firearm compared to operating with sound suppression enabled.

For descriptive purposes herein, apertures are defined to overlap when there is fluid communication directly through both apertures. Apertures do not overlap if there is no direct fluid communication path from one aperture through the other, for example when the two apertures are rotationally or translationally displaced from one another so that the edges of one aperture do not overlap the edges of the other.

In another selectable rotational position referred to as a closed-vent configuration, the apertures in the shroud tube are rotationally displaced from the apertures in the vent tube so that there are no direct passageways to the outside atmosphere for gas and particles from the bore in the vent tube through the nonoverlapping apertures in the vent tube and shroud tube. The apertures in the vent tube, when blocked from direct fluid communication with the outside atmosphere by the solid walls of the surrounding shroud tube, provide a series of reservoirs in fluid communication with the bore. The reservoirs modify the amplitude and shape of the discharge pressure pulse emitted from the end of the firearm into the bore of the sound suppressor 100, reducing the amplitude of sound from the discharge end of the sound suppressor. In the closed-vent configuration, the flow of gas and particles from the bore to the outside atmosphere through the vent tube apertures is blocked by the solid walls of the shroud tube. In the open-vent configuration, gas and particles entering the bore from the muzzle of the firearm may pass directly through the overlapping apertures in the vent tube and shroud tube to the outside atmosphere, minimizing sound suppression.

Sound suppression is enabled by the closed-vent configuration and minimized by the open-vent configuration. Sound suppression may be quickly and easily enabled and minimized by a person using a sound suppressor on a firearm, without removing the sound suppressor from the firearm and without the use of tools. When configured for operation with sound suppression minimized, the sound suppressor has little effect on the firing accuracy of the firearm, with firing accuracy and the loudness and/or sound intensity of discharge sound about the same as if no sound suppressor is present. When sound suppression is enabled, a sound suppressor embodiment provides a substantial decrease in the magnitude of discharge sound compared to operating without suppression. Sound suppression may be enabled and minimized without changing the weight and balance of the firearm. The examples of a sound suppressor disclosed herein are easily removed from a firearm for cleaning and storage.

In contrast to previously known sound reduction devices using K-baffles and the like, in which the baffles must be accurately aligned with the bore of a barrel to avoid baffle strikes by a projectile passing from the barrel through the device, embodiments of a sound suppressor are effective without baffles or other internal structures which need to be aligned accurately with the bore. For example, the bore through the vent tube of a sound suppressor embodiment may be larger than the bore on the firearm's barrel, reducing the need for accurate alignment of the two bores. However, some embodiments of a sound suppressor are compatible with the use of baffles if more sound suppression is desired. Embodiments of a sound suppressor are less prone to damage and wear than previously known sound reduction devices. Embodiments may be operated with less risk of fragmenting, melting, or rupture of the device than many previously known sound reducing devices, thereby providing for safer operation and more accurate firing results.

Example embodiments of a suppressor with selectable venting are shown in FIGS. 1-11. The example of a firearm discharge sound suppressor 100, also referred to herein as a sound suppressor 100, includes a hollow shroud tube 104 slidably and rotatably coupled to a vent tube 102. The shroud tube 104 may also be referred to herein as an outer tube 104. The shroud tube 104 is captured on the vent tube 102 between an end cap 132 and a rear cap 144. The rear cap 144 forms a barrel coupling 118 for removably connecting the sound suppressor 100 to the barrel of a firearm. The end cap 132 is at the discharge end 166 of the sound suppressor 100. A projectile emerging from the muzzle of a firearm passes through an aperture in the rear cap 144, through a bore 108 passing through the vent tube 102, and out a projectile exit aperture 120 in the end cap 132.

The shroud tube is longitudinally slidable along the vent tube toward 154 and away 156 from the muzzle 204. The shroud tube is also rotatable relative to the vent tube in a first direction 150 and an opposite direction 152. The vent tube 102 may fit into the hollow interior void space 164 of the shroud tube 104 with a sliding fit between the outer surface 110 of the vent tube and the inner surface 112 of the shroud tube. Alternatively, the vent tube 102 may fit into the shroud tube 104 with a close sliding fit. A gas-tight fit between the vent tube and shroud tube is not needed for effective sound suppression by the sound suppressor 100. A bore 108 extends all the way through the vent tube 102, end cap 132, and in some embodiments the rear cap 144, providing a clear path for a projectile passing through the sound suppressor 100. The bore 108 preferably has a diameter 174 the same size as, or possibly somewhat larger than, the bore of the firearm so that a projectile will not touch any part of the device 100, even when the bore 108 of the sound suppressor 100 and the bore of the firearm are not perfectly concentric.

Figure 5:
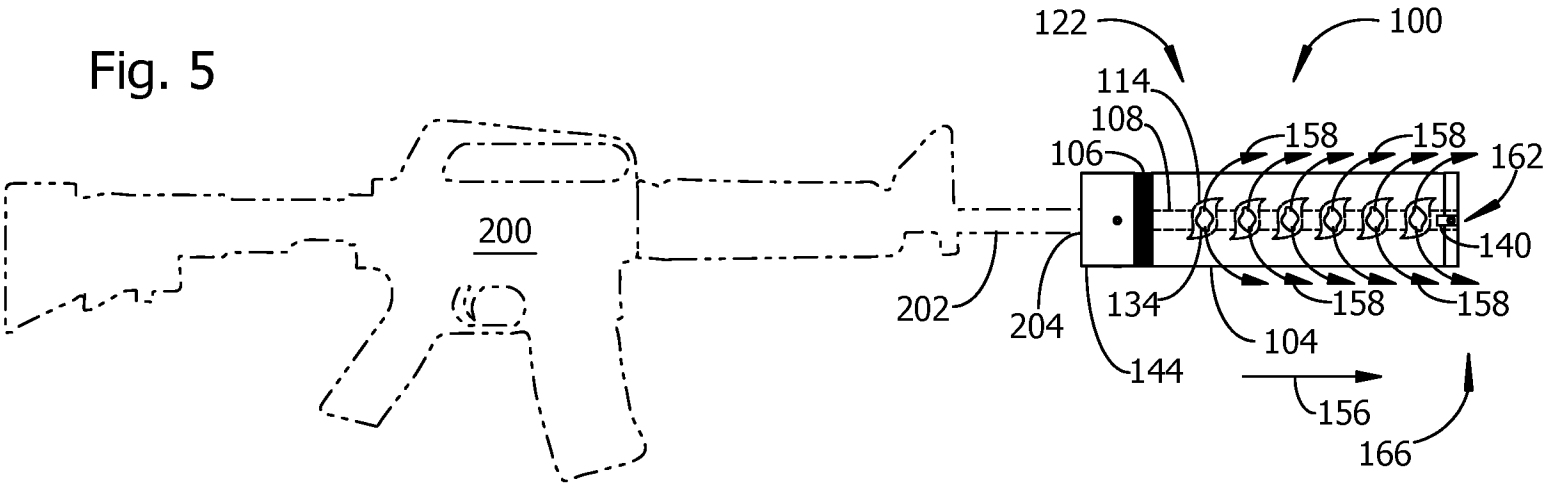
FIG. 5 shows a side view of an example sound suppressor embodiment attached to an example firearm, with the example sound suppressor configured for minimum sound suppression.
Figure 6:
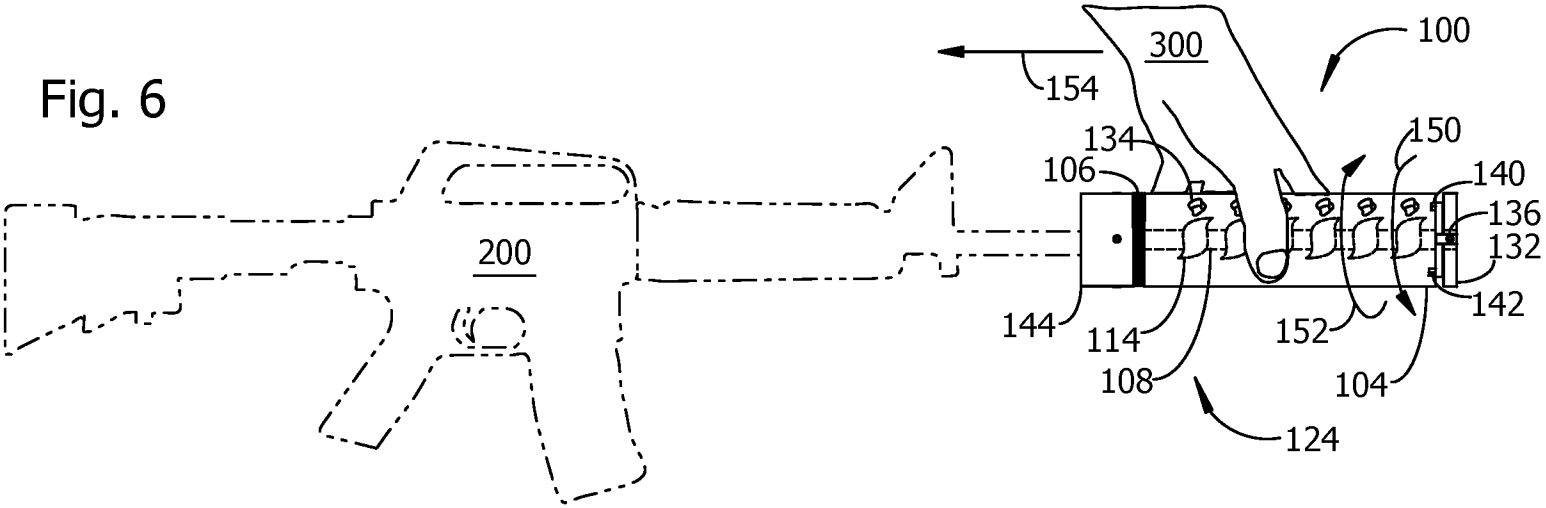
FIG. 6 continues the example of FIG. 5, showing the example sound suppressor configured for enablement of sound suppression.

The example of a suppressor 100 may be removably attached to the muzzle 204 of a barrel 202 on an example of a firearm 200. The firearm 200 in FIGS. 5 and 6 is shown as an example only. Other types of firearms may be used with the disclosed embodiments. As suggested by the broken-line outline, the firearm 200 is not part of a claimed embodiment 100. A threaded aperture 148 on the rear cap 144 is configured to receive a threaded section of the barrel 202 near the muzzle 204 of the firearm 200. The rear cap may be formed with a vent tube aperture 160 configured to receive an end 178 of the vent tube 102. The vent tube 102 may be retained in the vent tube aperture 160 by at least one cap fastener 146 removably joining the vent tube and rear cap. The vent tube may alternatively be formed as an integral part of the rear cap or may be joined to the rear cap by welding. The end cap 132 may be formed as an integral part of the vent tube 102 or may alternatively be attached to the vent tube by a fastener or by welding.

Figure 11:
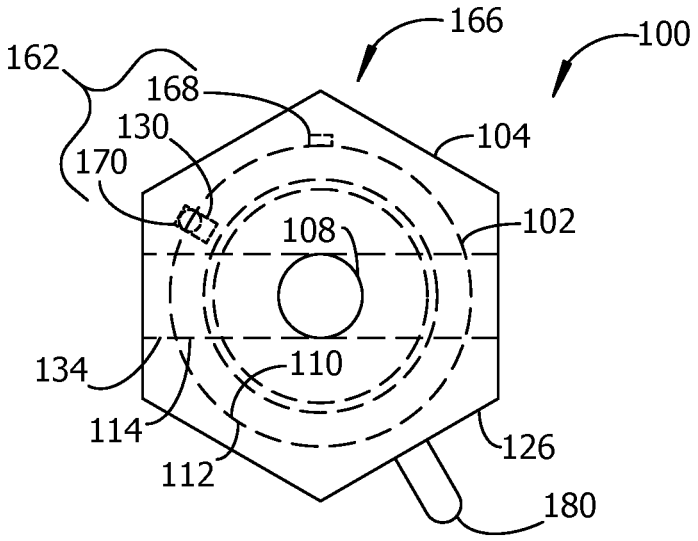
FIG. 11 shows a view toward the discharge end of another example of a sound suppressor embodiment having at least one flat side, and further illustrating an example of a ball detent indexing mechanism for selectively holding the shroud tube in either a vented position for minimizing sound suppression or an unvented position for enabling sound suppression.

The shroud tube 104 is formed as a hollow tube with interior void space 164, an outer surface 126, and the inner surface 112. In the examples shown in the figures, the shroud tube 104 and vent tube 102 have approximately cylindrical shapes. In alternative embodiments, the inner and outer surfaces of the shroud tube and the outer surface 110 of the vent tube may be formed with flat surfaces or a combination of flat and curved surfaces. For example, alternative embodiments of the shroud tube 104 may be formed with a square, hexagonal, or octagonal shape, optionally with a cylindrical central void 164 to accept a cylindrical vent tube 102. An embodiment of a shroud tube 104 having at least one flat side, as shown in the example of FIG. 11, may resist rolling down an inclined surface when the sound suppressor 100 is detached from a firearm.

A plurality of apertures 134, also referred to as shroud vents 134, are formed through the walls of the shroud tube 104. The shroud vents 134 are in fluid communication with the void space 164 in the interior of the shroud tube. Another plurality of apertures 114, also referred to as vent tube apertures 114, are formed through the walls of the vent tube 102. The vent tube apertures 114 pass through the outer surface 110 of the vent tube and the inner surface 172 of the bore, establishing fluid communication between the outside atmosphere and the bore 108 through aligned apertures (114, 134) in the shroud tube and vent tube. The bore 108 forms the projectile exit aperture 120 where the bore intersects the outside surface of the end cap 132. The external atmosphere is in fluid communication with the bore 108 when the vent tube apertures 114 and shroud v 134 are aligned with one another. The vent tube apertures 114 and shroud vents 134 are preferably formed in positions such that in some rotational orientations of the vent tube and shroud tube the apertures overlap one another to form the open-vent configuration corresponding to sound suppression being minimized, and in other rotational orientations of the vent tube and shroud tube the vent tube apertures 114 and shroud vents 134 do not overlap one another, corresponding to sound suppression being enabled.

Figure 2:
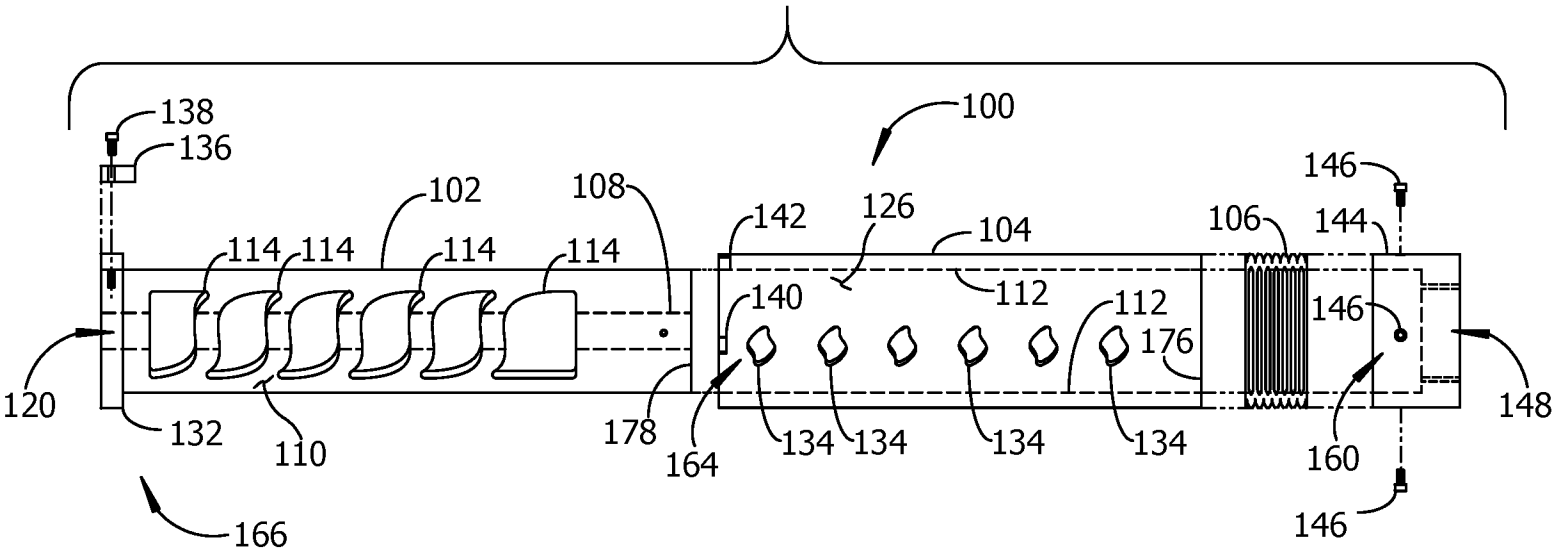
FIG. 2 shows an exploded side view of components included in the example apparatus of FIG. 1.
Figure 4:
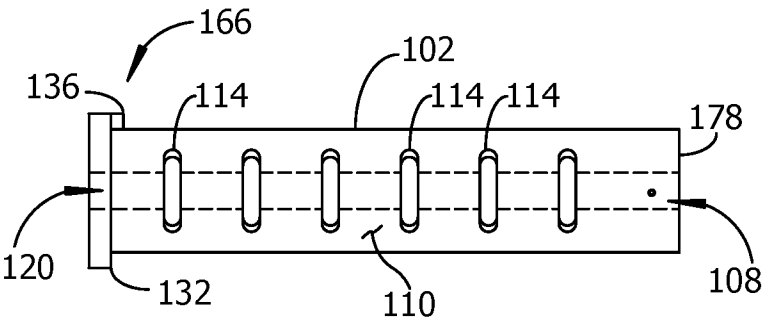
FIG. 4 shows a side view of an example of a vent tube with obround vent apertures.
Figure 3:
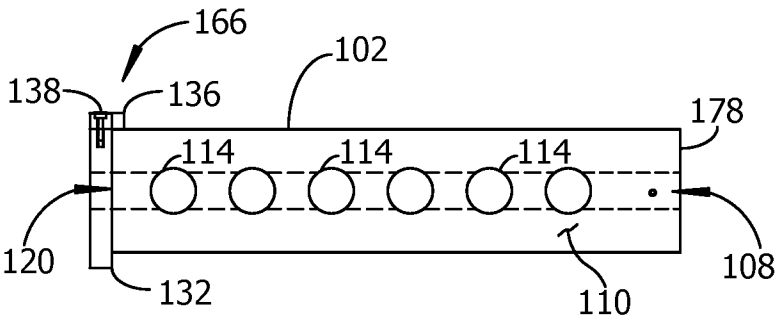
FIG. 3 shows a side view of an example of a vent tube with round vent apertures.

In the example of FIG. 2, the vent tube apertures 114 and shroud vents 134 have arcuate shapes. The vent tube apertures 114 may alternatively have circular shapes as suggested in the example of FIG. 3, be formed as rounded slots as in the example of FIG. 4, or have other shapes. Vent tube apertures 114 and shroud vents 134 may alternatively have a same size and shape, sizes that differ from one another, or shapes that differ from one another. An embodiment 100 may have a different number of vent tube apertures 114 and shroud vents 134 than are shown in the examples in the figures. Although the illustrated examples show all the apertures formed in a line along a side of each tube (102, 104), alternative configurations may place the apertures in any position that permits the sound suppressor 100 to be set for the open-vent configuration 122 and closed-vent configuration 124.

The example sound suppressor 100 includes an indexing mechanism 162 for selectively holding the shroud tube 104 in one of at least two preset rotational configurations relative to the vent tube 102. As shown in the examples of FIGS. 1-10, the indexing mechanism 162 may include a latch block 136 extending from the end cap 132 toward the rear cap 144, a fastener 138 for joining the latch block to the end cap 132, at least two notches formed at an end of the shroud tube 104, the at least two notches including a vent-open notch 140 and a vent-closed notch 142, and a spring 106 for holding the rotation stop in a selected notch. The latch block 136 may be referred to as the rotation stop 136. The latch block 136 may alternatively be formed as a separable piece as shown in the figures or as an integral part of the end cap 132 or vent tube 102. A spring 106 interposed between the rear cap 144 and the shroud tube 104 urges an end 176 of the shroud tube toward the end cap 132 in the direction marked by an arrow 156. Examples of a spring include, but are not limited to, a helical spring, a wave spring, and one or more coned-disk springs. A coned-disk spring may be referred to as a Belleville washer.

The shroud tube 104 is free to rotate about the vent tube 102 until the indexing mechanism 162 engages the latch block 136 in one of the notches (140, 142). The spring, rotation stop, and notches cooperate to hold the shroud tube stationary relative to the vent tube with the vents aligned for disabling sound suppression, or with the vents misaligned and blocked from fluid communication with the bore for enabling sound suppression. Pulling the shroud tube 104 in the direction indicated by an arrow 154 compresses the spring 106 and disengages the latch block 136 from one of the notches, enabling the shroud tube to be rotated until the rotation stop engages another notch. Releasing the shroud tube disengages the latch block from a notch (140, 142), permitting the shroud tube to be rotated about the vent tube to another notch.

Alternative embodiments of a sound suppressor 100 may have more than two notches formed in the shroud tube. More than two notches may be configured to bring different groupings, sizes, and/or shapes of vent apertures into alignment for providing differing amounts of sound suppression.

FIGS. 5 and 6 show examples of a sound suppressor 100 attached to the muzzle 204 on the barrel 202 of an example firearm 200. FIG. 5 represents an example of the open-vent configuration 122 for minimizing sound suppression. The indexing mechanism 162 is shown in an example of an engaged position, with the spring 106 holding the shroud tube 104 firmly against the end cap 132, the latch block 136 inserted in the vent-open notch 140, and some of the outflow 158 of gas and/or particles from discharge of the firearm passing though the bore 108 and through the overlapping shroud vents 134 and vent tube apertures 114 to the external atmosphere.

FIG. 6 represents an example of the sound suppressor 100 being moved to the closed-vent configuration 124. In the example of FIG. 6, the spring 106 is being compressed by a human hand 300 pulling the shroud tube 104 toward the rear cap 144 in the direction marked by an arrow 154. The latch block 136 is disengaged from the vent-open notch 140 and the shroud tube is being rotated in a direction 152 to bring the latch block 136 into engagement with the vent-closed notch 142. FIG. 6 further shows examples of the shroud apertures 132 and vent tube apertures 114 rotationally displaced away from one another so that the vent tube apertures and shroud tube apertures are not overlapping one another. In the closed-vent configuration 124, fluid communication between the bore 108 and the external atmosphere through the shroud vents 134 is greatly reduced compared to the open-vent configuration 122, thereby providing effective sound suppression. Engaging the latch block 136 in the vent-closed notch 142 holds the sound suppressor 100 firmly in the closed-vent configuration 124 through force exerted by the spring 106. As suggested by FIG. 6, the shroud tube 104 may also be rotated in a direction 150 to engage the rotation stop with the vent-open notch 140, disabling sound suppression as in the example of FIG. 5.

FIGS. 7-8 show more details of an example sound suppressor 100. In FIGS. 7-8, the sound suppressor 100 is shown in an example of a configuration for minimized sound suppression 122, also referred to as an open-vent configuration 122 with the vent tube apertures 114 and the shroud vents 134 aligned with one another to form a fluid path from the bore 108 to the outside atmosphere. In the example of FIG. 8, the bore diameter 174 is substantially smaller than the outer diameter of the vent tube 102. The bore diameter 174 may optionally be made large enough to accept one or more baffles such as K-baffles or the like.

A handle 180 may optionally be attached to the shroud tube 104. The handle may remain cooler than the exterior surface of the shroud tube after discharge of the firearm, thereby providing a safe and comfortable means for selectively placing the example suppressor 100 in the closed-vent configuration or open-vent configuration by moving the shroud tube relative to the vent tube. An example of a handle 180 is shown in FIGS. 7, 8, and 11. The handle may be attached by one or more fasteners, by welding, or may be formed as an integral part of the shroud tube. A suppressor 100 may include a handle 180 with a different shape and/or a handle positioned differently than the illustrated examples. A handle 180 may be made from a same material as the shroud tube or may alternatively be made from a material having lower thermal conductivity than the material of the shroud tube.

Figure 9:
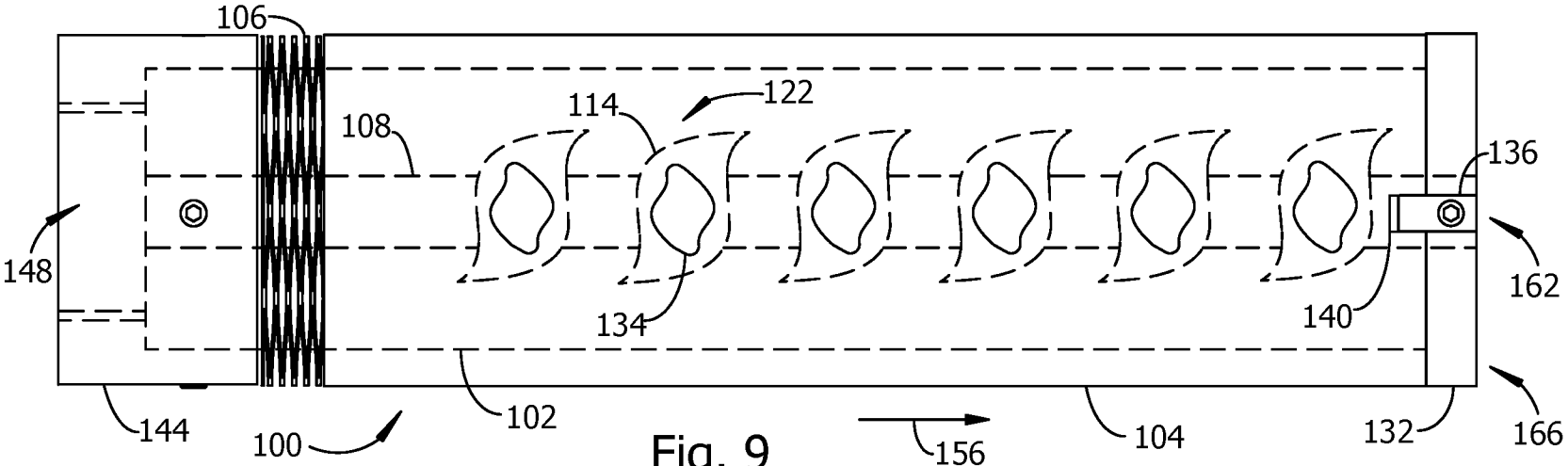
FIG. 9 is a side view of an example sound suppressor embodiment configured for minimum sound suppression.
Figure 10:
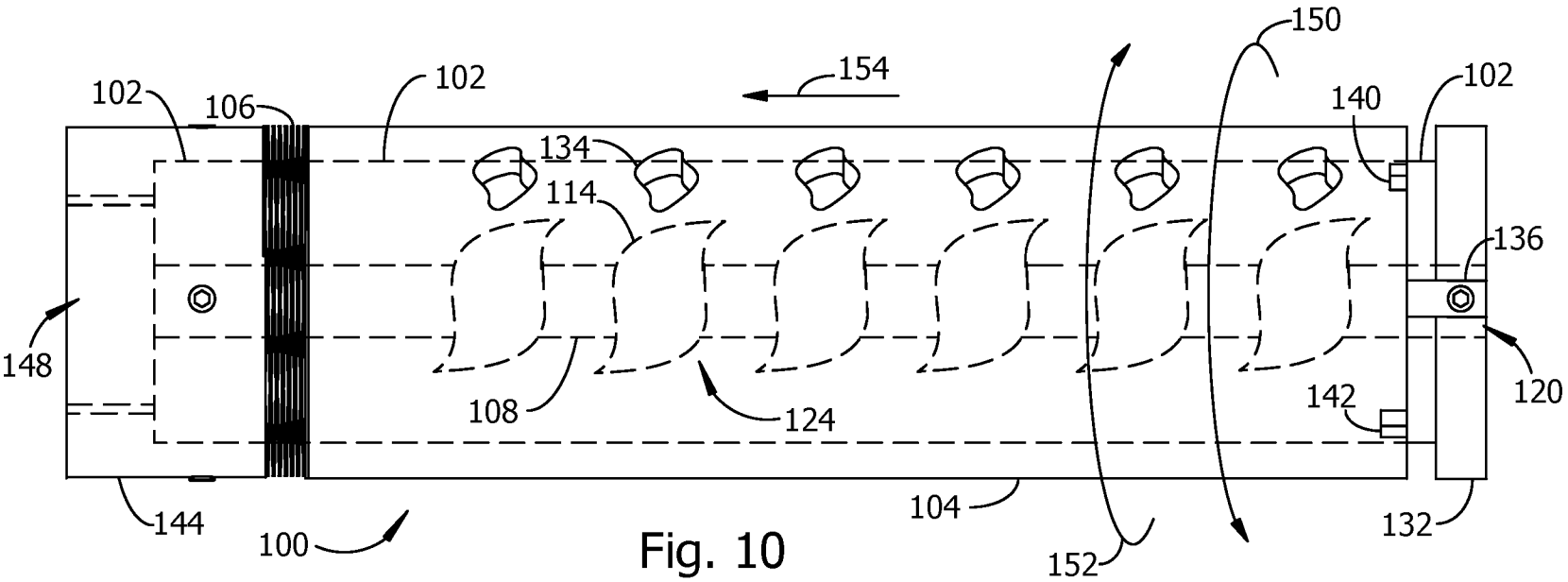
FIG. 10 continues the example of FIG. 9, showing an adjustment to the position of the shroud tub relative to the vent tube to enable sound suppression.

FIG. 9 shows a side view of an example sound suppressor 100 in the open-vent configuration 122 for minimized sound suppression. FIG. 9 further shows an example of the latch block 136 engaged with the vent-open notch 140 to hold the shroud tube 104 in the open-vent configuration relative to the vent tube 102. FIG. 10 shows the example sound suppressor 100 of FIG. 9 with the shroud tube 104 rotationally positioned to misalign the shroud vents 134 and the vent tube apertures 114 to configure the sound suppressor 100 for enablement of sound suppression. The shroud tube 104 may be held in the closed vent-configuration 124 for enablement of sound suppression by rotating the shroud tube until the latch block 136 engages the vent-closed notch 142.

The indexing mechanism 162 may alternatively be implemented with a ball detent mechanism as suggested in the example of FIG. 11. A ball spring plunger 130 inset into the vent tube 102 is positioned to engage a vent-open detent 170 formed in the shroud tube 104 and a vent-closed detent 168. The shroud tube 104 may be rotated relative to the vent tube 102 to engage the ball spring plunger in either detent for selective enablement or minimization of sound suppression. More than two detent positions may optionally be provided to enable selectable amounts of sound suppression.

In the illustrated examples, the indexing mechanism 162 has been positioned at the discharge end 166 of the sound suppressor 100. The indexing mechanism may be alternatively be near the end of the sound suppressor 100 closest to the barrel of a firearm when the device 100 is installed on the firearm. For example, the spring 106 may be positioned at the discharge end of the sound suppressor 100 and the latch block 136 and notches (140, 142) at the end near the rear cap 144. In an embodiment with ball detents, the ball detent components may alternatively be placed near the rear cap 144, or with the ball spring plunger 130 on the shroud tube 104 instead of the vent tub 102.

Unless expressly stated otherwise herein, ordinary terms have their corresponding ordinary meanings within the respective contexts of their presentations, and ordinary terms of art have their corresponding regular meanings.

What is claimed is:

1. An apparatus, comprising:

a vent tube formed with a bore extending from a first end of said vent tube to a second end of said vent tube, and said vent tube formed with a plurality of vent tube apertures, each of said vent tube apertures passing through an outer surface of said vent tube into said bore;

a shroud tube rotatably coupled to said vent tube, said shroud tube formed with a plurality of shroud apertures, each of said shroud apertures passing through an outer surface of said shroud tube into an interior void formed in said shroud tube, and said vent tube positioned within said interior void;

a spring interposed between an end of said shroud tube and said first end of said vent tube, said spring positioned to urge said end of said shroud tube away from said first end of said vent tube;

a rear cap attached to said vent tube, the rear cap configured for attachment to a muzzle of a firearm; and an indexing mechanism configured for selectively holding said vent tube and said shroud tube in an open-vent configuration with said shroud apertures in fluid communication with said bore in said vent tube through said vent tube apertures and a closed-vent configuration with said vent tube apertures blocked by a solid wall of said shroud tube.

2. The apparatus of claim 1, wherein said shroud apertures do not overlap said vent tube apertures in said closed-vent configuration.

3. The apparatus of claim 2, where said shroud apertures are not in fluid communication with said bore in said closed-vent configuration.

4. The apparatus of claim 1, wherein said shroud apertures at least partially overlap said vent tube apertures in said open-vent configuration.

5. The apparatus of claim 4, wherein said shroud apertures are in fluid communication with said vent apertures and said bore in said open-vent configuration.

6. The apparatus of claim 1, wherein said indexing mechanism comprises:

a latch block attached to said vent tube;

a vent-open notch formed in said shroud tube, said vent-open notch positioned to align said plurality of vent tube apertures with said plurality of shroud apertures when said latch block engages said vent-open notch; and a vent-closed notch formed in said shroud tube, said vent-closed notch positioned to prevent overlap of said vent tube apertures and said shroud apertures when said latch block engages said vent-closed notch, thereby preventing fluid communication between said shroud apertures and said bore.

7. The apparatus of claim 1, wherein said indexing mechanism comprises:

a ball spring plunger attached to said vent tube;

a vent-open detent formed in said shroud tube, said vent-open detent positioned to align said plurality of vent tube apertures with said plurality of shroud apertures when said ball spring plunger engages said vent-open detent;

and a vent-closed detent formed in said shroud tube, said vent-closed detent positioned to prevent overlap of said vent tube apertures and said shroud apertures when said ball spring plunger engages said vent-closed detent.

8. The apparatus of claim 1, wherein said shroud tube is slidably coupled to said vent tube.

9. The apparatus of claim 1, wherein said shroud tube is rotatably coupled to said vent tube.

10. The apparatus of claim 1, further comprising a handle attached to said shroud tube.

* * * * *